United States Patent [19]

Maier-Hunke et al.

[11] Patent Number: 4,487,520

[45] Date of Patent: Dec. 11, 1984

[54] FOLDER

[75] Inventors: Horst-Werner Maier-Hunke, Iserlohn; Werner H. G. Pfannkuch, Hemer; Friedrich Vieler, Iserlohn-Sümmern, all of Fed. Rep. of Germany

[73] Assignee: Hunke & Jochheim, Iserlohn, Fed. Rep. of Germany

[21] Appl. No.: 324,036

[22] Filed: Nov. 23, 1981

[30] Foreign Application Priority Data

| | | | |
|---|---|---|---|
| Dec. 2, 1980 | [DE] | Fed. Rep. of Germany | 3045815 |
| Dec. 2, 1980 | [DE] | Fed. Rep. of Germany | 3045816 |
| Feb. 20, 1981 | [DE] | Fed. Rep. of Germany | 3107093 |
| Mar. 13, 1981 | [DE] | Fed. Rep. of Germany | 3110551 |

[51] Int. Cl.[3] ..... B42F 13/36; B42F 13/06; B42F 13/00; B42D 5/00

[52] U.S. Cl. ..... 402/65; 402/4; 402/17; 281/15 A

[58] Field of Search ..... 402/4, 17, 65; 281/15 A, 15 B

[56] References Cited

U.S. PATENT DOCUMENTS

| | | | |
|---|---|---|---|
| 3,080,562 | 3/1963 | Potts et al. | 402/17 |
| 3,628,877 | 12/1971 | Barnes, Jr. | 402/17 |
| 3,865,445 | 2/1975 | Dean et al. | 402/4 |
| 3,957,321 | 5/1976 | Rose | 402/17 |
| 4,302,123 | 11/1981 | Dengler | 402/17 |

FOREIGN PATENT DOCUMENTS

| | | | |
|---|---|---|---|
| 2089324 | 7/1972 | France | 402/17 |

*Primary Examiner*—R. L. Spruill
*Assistant Examiner*—Paul M. Heyrana, Sr.
*Attorney, Agent, or Firm*—Parmelee, Bollinger & Bramblett

[57] ABSTRACT

In a folder for receiving documentary material, which is provided with profile bars (3) and slides (6) guided on these for retaining thread-on wires (5) insertable through orifices in the profile bar (3), a cam (9) located on the profile bar is used to retain the slide (6) in a filing position, and this cam is formed by a profile-bar bottom section punched out of the profile bar (3) and extending obliquely upwards towards the end of the profile bar and makes it possible to retain especially securely an engagement stop (17) which is located on the slide (6) and which, if required, can be lifted by the user over the cam (9) in order to displace the slide (6) towards the center of the profile bar (3).

16 Claims, 17 Drawing Figures

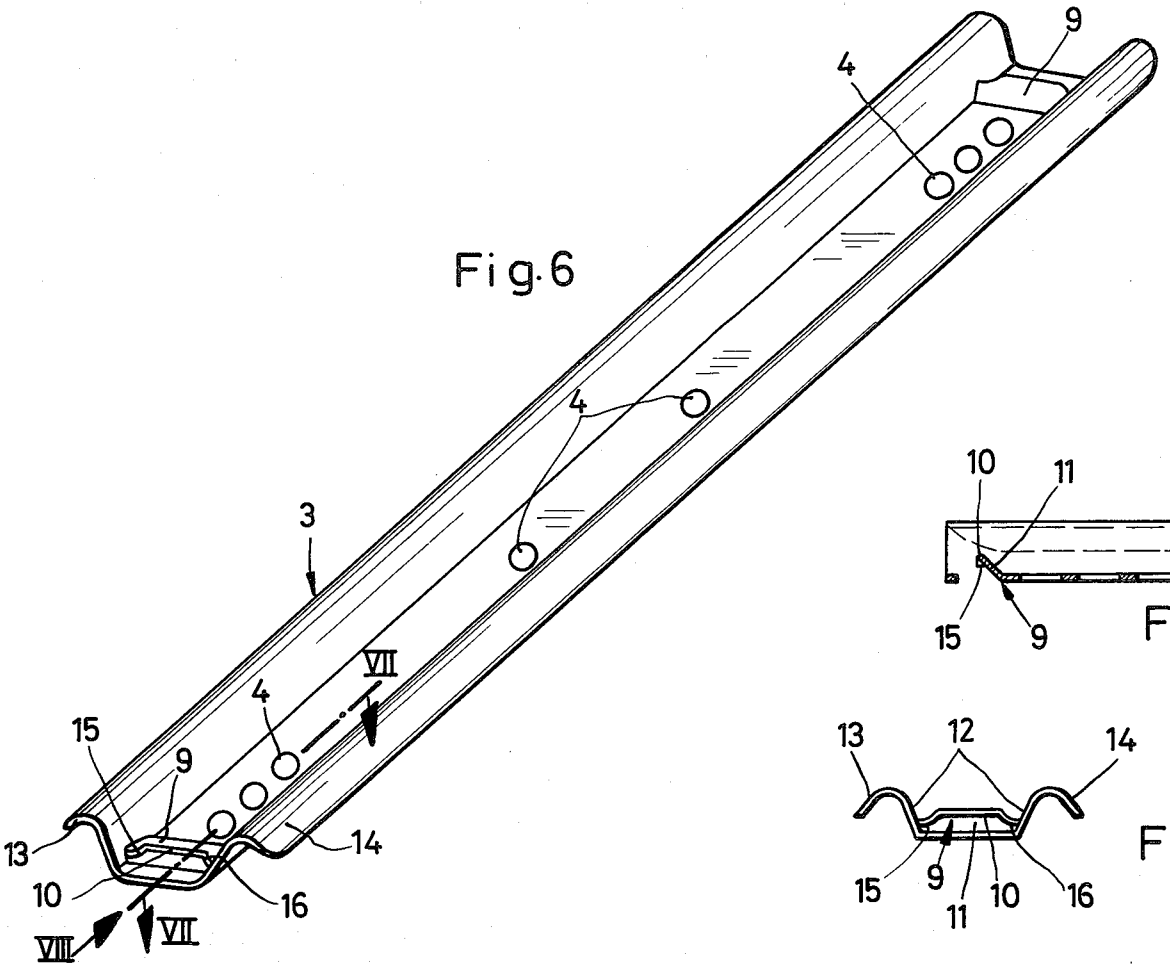
Fig.6
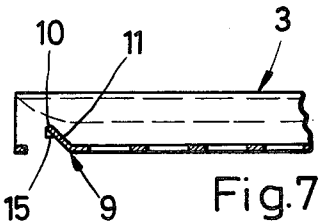
Fig.7
Fig.8

FOLDER

BACKGROUND OF THE INVENTION

The invention relates to a folder for receiving documentary material, especially tabulating paper, with two covers, at least one of which is provided, in the region of the folder spine, with a profile bar which has a trough part with insertion orifices for thread-on wires serving to retain the documentary material and onto which slides for firmly clamping the thread-on wires can be clipped, these slides having a guide partially surrounding the profile bar and each being made hook-like at one end, the profile bar being provided at each bar end with at least one cam to which are assigned on the particular slide stops which, interacting with the cam, on the one hand counteract the pulling-off of the slides from the profile bar and, on the other hand, determine the position of the slides in a hanging position in which their hook-like ends project beyond the ends of the profile bar, there being provided on the slide at least one further stop which defines the position of the slide pushed from the bar end onto the particular thread-on tongue in a filing position in which the rear end of the slide terminates essentially flush with the end of the profile bar.

SUMMARY OF THE INVENTION

According to the invention, this object is achieved due to the fact that the cams at the bar ends are located in the trough part of the bar and the further stop of each slide is designed as an engagement stop which fits into the trough part and which can be moved by the user of the folder over the cam assigned to it, under the effect of force, in such a way that the slide can be displaced beyond the position defined by the engagement stop to the center of the profile bar, provided with insertion orifices.

The folder according to the invention offers the advantage that its scope of application is extended in comparison with known folders of the relevant type and that because of the chosen arrangement and design of the engagement stop it is impossible to over-run a thread-on wire with the slide in the direction of the free end of the wire.

It proves especially advantageous if each of the cams assigned to an engagement stop consists of a profile-bar bottom section punched out of the profile bar and extending obliquely upwards towards the end of the profile bar. Cams of this type prevent injury to the hand on the profile bar, which is usually made of metal, especially sheet steel, even when the slides are pressed into the filing position with a vigorous blow of the hand against their outer ends. To make it easier to handle the folder, it is also recommended to give the slides an ergonomically favorable shape by providing force introduction ramps in the region of the ends of each slide and on its upper side and by equipping each slide, between the force introduction ramps, with lateral finger-grip depressions located opposite one another which, to make the design of the slides as space-saving as possible, should extend obliquely downwards from the upper sides of the slides.

BRIEF DESCRIPTION OF THE DRAWINGS

Further details and features of the invention emerge from the claims and the following description. In the attached drawing:

FIG. 6 shows a perspective view of a further profile bar;

FIG. 7 shows a section along the line VII—VII in FIG. 6;

FIG. 8. shows an end view of the profile bar according to FIG. 6, looking in the direction of the arrow VIII in FIG. 6;

DISCUSSION OF THE PREFERRED EMBODIMENT

Figures 1, 2:
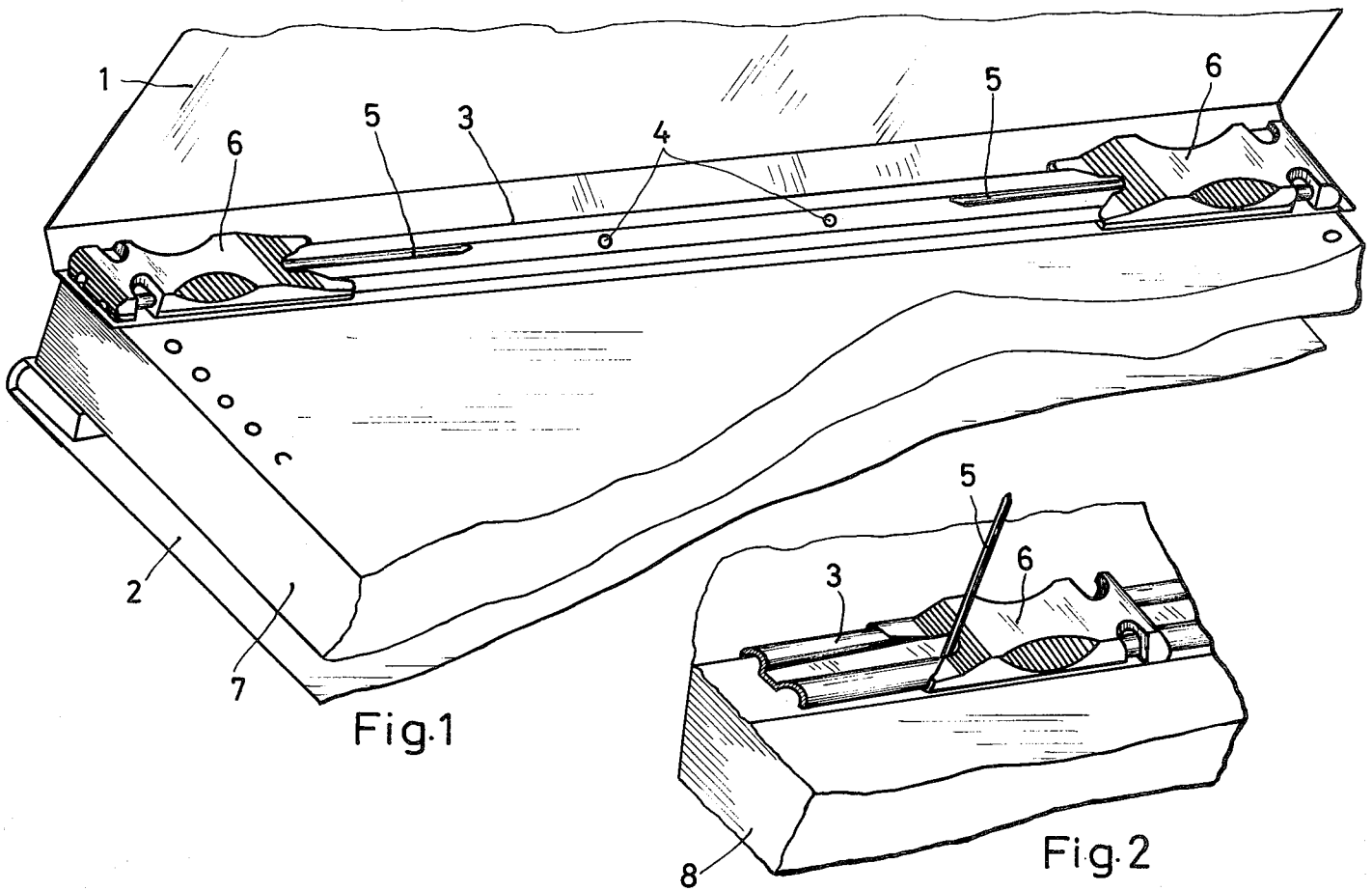
FIG. 1 shows a perspective partial view of a folder with a slide located in the filing position.
FIG. 2 shows part of the folder illustrated in FIG. 1, with a slide shifted towards the center of the profile bar of the folder.

In FIG. 1, 1 and 2 denote the covers of a folder which serves for storing folded sheets of computer print-out. Fastened to the cover 1 is a profile bar 3 which is provided with a plurality of insertion orifices 4 for thread-on wires 5. Clipped onto the profile bar 3 are slides 6 which engage laterally behind the profile bar 3 and serve to clamp the thread-on wires firmly between them and the bottom of the profile bar. In FIG. 1, the slides 6 are in the filing position of the folder. In the case illustrated, the thread-on wires are inserted through perforation holes in the documentary material 7 consisting of folded sheets of paper. When a stack of paper 8 with normal punched holes is to be removed, the slides 6 must be displaced from the ends of the profile bar 3 towards its center, as is indicated in FIG. 2. FIG. 2 shows a slide 6 and a thread-on wire 5 before the thread-on wire is bent over and clamped firmly by means of the slide 6.

Figures 3, 4, 5:
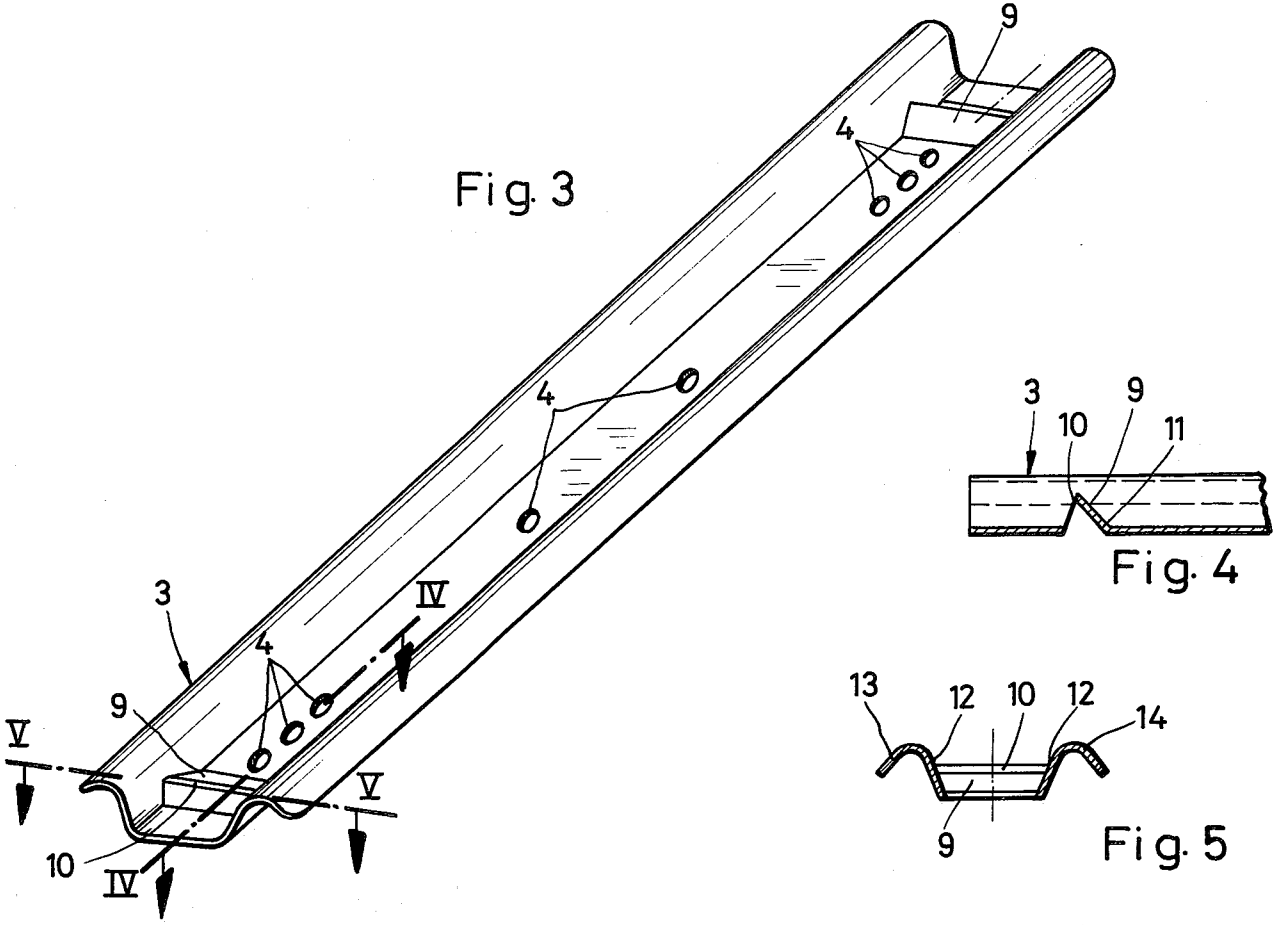
FIG. 3 shows a perspective view of a profile bar.
FIG. 4 shows a section along the line IV—IV in FIG. 3.
FIG. 5 shows a section along the line V—V in FIG. 3.

As may be seen from FIGS. 3 to 5, the profile bar 3 is provided with a cam 9 at each of the bar ends. A cut edge 10 and a slopig face 11 of the cam 9 interact with stops on the slides 6.

The profile bar 3 has an essentially U-shaped trough part 12 which is adjoined by angled retaining legs 13,14.

FIGS. 6 to 8 illustrate a further profile bar, the same reference numerals as in FIGS. 3 to 5 being used for parts corresponding to one another. The modified profile bar again possesses an essentially U-shaped trough part 12 which is adjoined by angled retaining legs 13, 14. Here too, the cam 9 has a cut edge 10 and a sloping face 11. In contrast to the first exemplary embodiment, the stop edge 10 does not extend in a straight line over the entire width of the trough part, but it has, in the vicinity of the essentially V-shaped profile bar margins, shoulders 15 and 16 which slope down towards the bottom of the profile bar. In the region of these shoulders 15,16, the cut edge 10 is bent more or less sharply towards the bottom of the profile bar.

Figure 9:
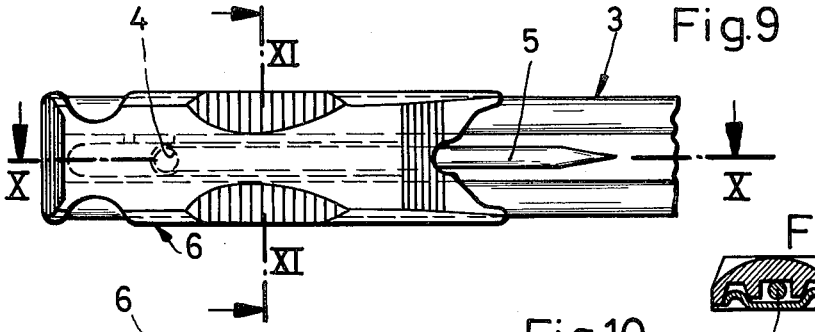
FIG. 9 shows a plan view of a slide in the filing position.
Figure 11:
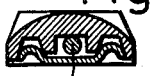
FIG. 11 shows a section along the line XI—XI in FIG. 9.
Figure 10:
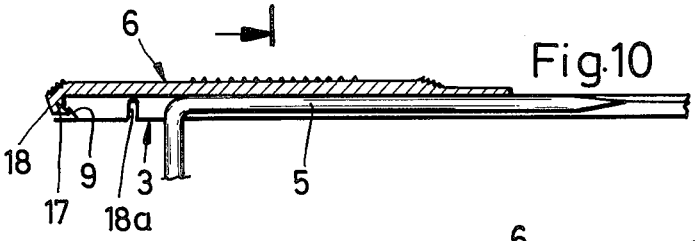
FIG. 10 shows a section along the line X—X in FIG. 9.

FIG. 9 shows a plan view of a slide 6 in the filing position. As can be seen especially from the cross-section according to FIG. 10, the cam 9 is located at a point on the profile bar 3 which ensures that the rear end of the slide terminates flush with the end of the profile bar 3 assigned to it. The location of the slide 6 in the position illustrated in FIGS. 1,9 and 10 is determined by a stop 17 in the region of the end of the slide 6. As emerges from FIG. 14, the stop 17 has a stop face 17*a* which forms an angle of at most 90° with the bottom of the slide 6. Unintentional overrunning of the cam is thus prevented. To reinforce further the locking between the cam 19 and the stop 17, the stop 17 is provided additionally with a projection 17*b*.

When the slide 6 is to be shifted out of the position shown in FIGS. 1, 9 and 10 towards the center of the profile bar 3, the stop 17 must be lifted over the cam 9. To make it easier to raise the rear end of the slide, the latter can be deformed elastically about a transverse axis extending perpendicularly to its longitudinal axis. Moreover, the slide is provided at its rear end with a sloping face 18 which, like notches 18*a*, makes it easier to raise the rear end of the slide.

Figure 13:
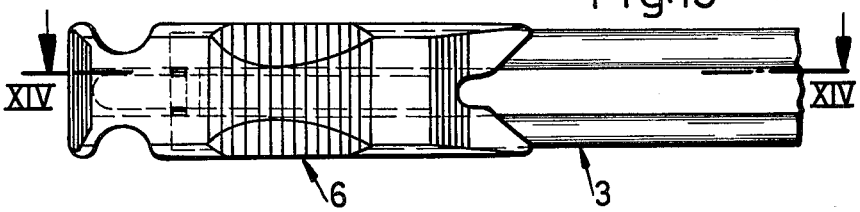
FIG. 13 shows a plan view of a slide in the hanging position of the folder, with the thread-on wires omitted.
Figure 14:
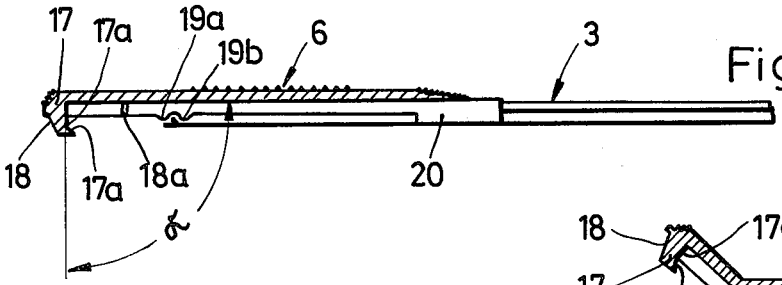
FIG. 14 shows a section along the line XIV—XIV in FIG. 13.
Figure 15:
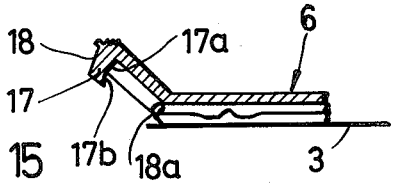
FIG. 15 shows the raised rear end of a slide.

FIGS. 13 and 14 show the slide 6 in the hanging position of the folder, the thread-on wires 5 having been omitted from these Figures for the sake of clarity. In the hanging position, the cam 9 interacts with a pair of stops 19*a*, 19*b*. A further stop 20 of the slide is intended to hold the slide on the profile bar 3 during the time when it is transferred into a position in which it exposes the insertion orifice 4 indicated in FIG. 9.

Figure 16:
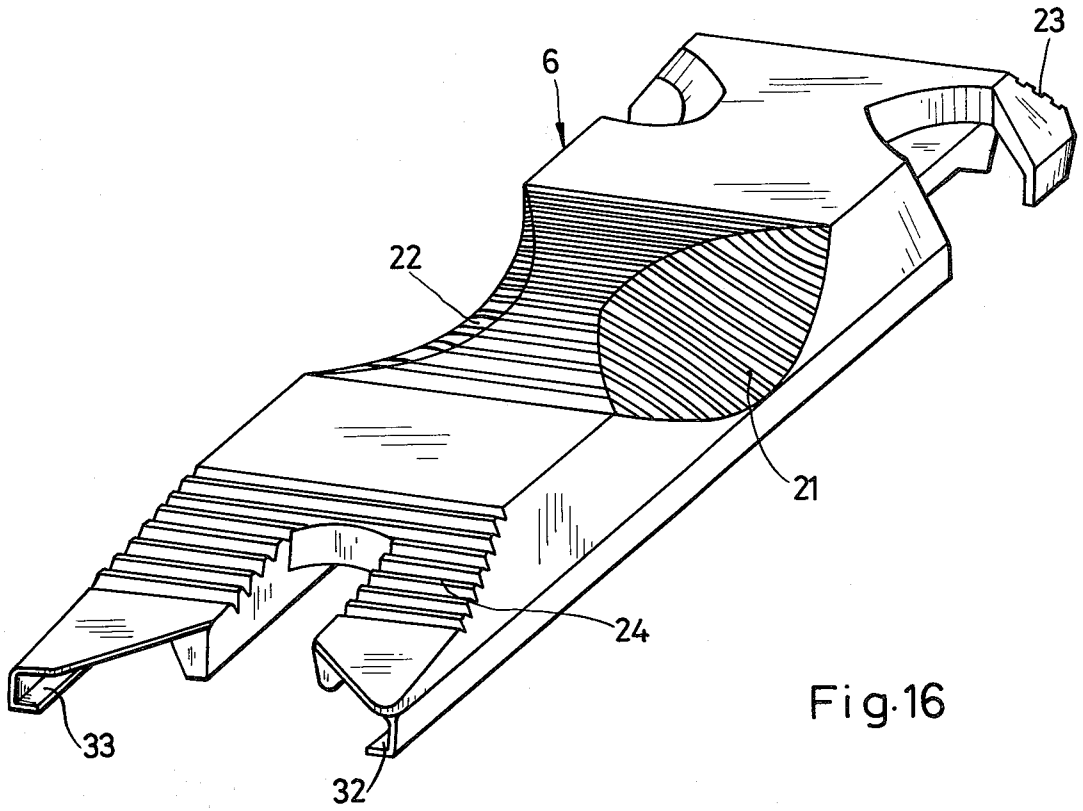
FIG. 16 shows, on an enlarged scale, a perspective view of the slide, looking from above.
Figure 17:
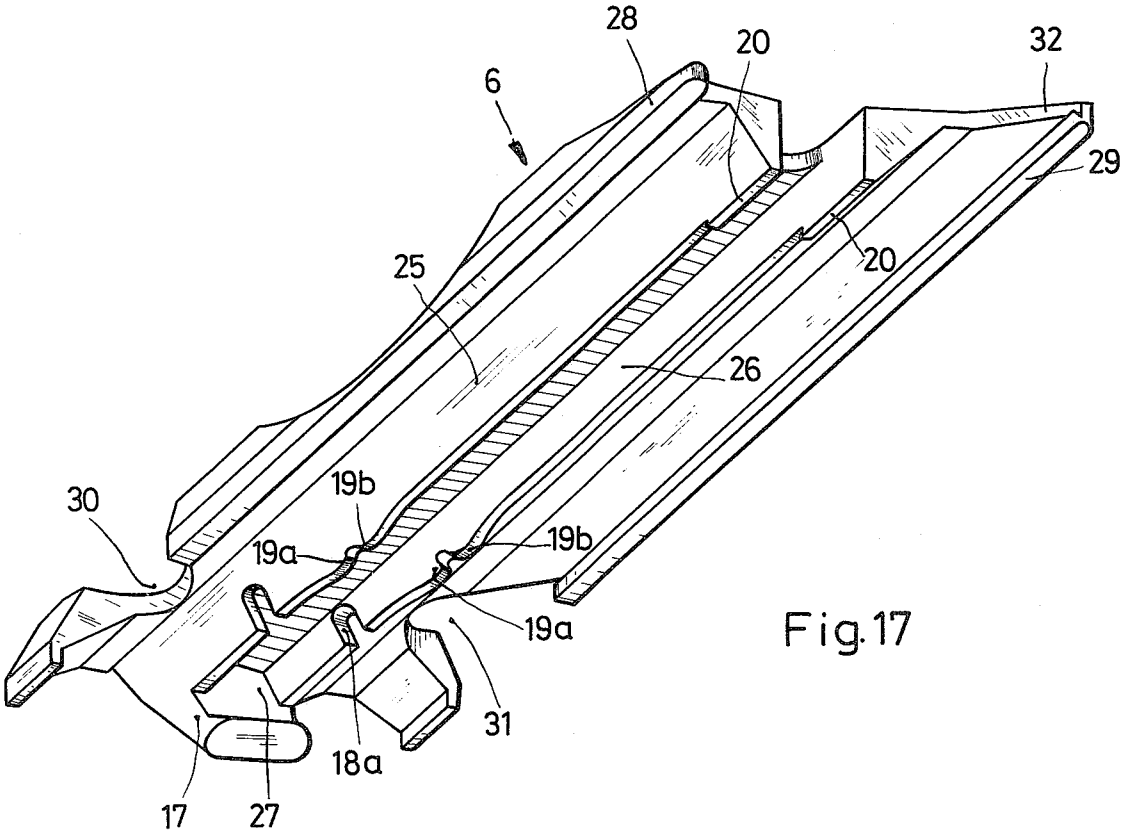
FIG. 17 shows, on an enlarged scale, a perspective view of the slide, looking from below.

Details of the design of the slide 6 emerge from FIGS. 16 and 17.

On its outside each slide is provided with finger-grip depressions 21 and 22 and with pressure faces forming force introduction ramps 23 and 24. To improve grip, the finger-grip depressions 21 and 22 and the force introduction ramps 23 and 24 are knurled. The knurling of the finger-grip depressions 21 and 22 extends over the entire surface of the slide 6.

Figure 12:
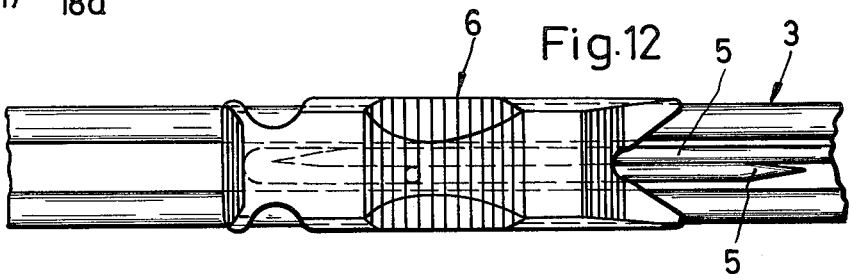
FIG. 12 shows a plan view of a slide displaced towards the center of the profile bar.

The stops 19*a* and 19*b* as well as 20 which have already been mentioned are formed by projections of two guide webs 25 and 26 located on the underside of the slide 6, the distance between these being sufficiently great to allow two thread-on wires 5 to be received in the channel limited by the guide webs 25 and 26 and the upper side of the slide, as is indicated in FIG. 12. In the region of the rear end of the slide 6, the guide webs 25 and 26 are connected to one another by means of a cross-webb 27. As may be seen from FIG. 17, the cross-web 27 merges into the stop 17.

Two outer webs 28 and 29 extend parallel to the guide webs 25 and 26 which form center webs. Recesses 30 and 31 are provided at the end of the slide. The parts of the outer webs 28 and 29 which extend from the recesses 30,31 to the end of the slide facing away from the cross-web 27 are provided with retaining lips 32 and 33. When the slide 6 is clipped onto the profile bar 3, these retaining lips rest against the lower margins of the retaining legs 13 and 14. The retaining lips are missing in the region between the recesses 30 and 31 and the rear end of the slide, that is to say the end having the stop 17, so that it is readily possible to raise the rear end of the slide 6.

We claim:

1. Folder for receiving documentary material, especially tabulating paper, with two covers, at least one of which is provided in the region of the folder spine with a profile bar which has a trough part with insertion orifices for thread-on wires serving to retain the documentary material and onto which slides for firmly clamping the thread-on wires can be clipped, these slides having front and rear ends and a guide partially surrounding the profile bar, each slide being made hook-like at one end, the profile bar being provided in its trough part at each bar end with at least one cam (9) which interacts with a plurality of stops (19*a*, 19*b*, 20) on each slide including at least a first stop (20) to counteract the pulling-off of the slides from the profile bar, and at least a second stop (19*a*, 19*b*) to determine the position of the slides in a hanging position in which their hook-like ends project beyond the ends of the profile bar, there being provided on the slide at least one further stop which is an engagement stop (17) extending from the rear end of the slide for engaging the cam (9) for defining the position of the slide in a filing position in which the rear end of the slide pushed from the bar end onto the particular thread-on tongue terminates essentially flush with the end of the profile bar, said engagement stop (17) of each slide (6) being designed to fit into the trough part (12) and to be moved by the user of the folder over the cam (9) assigned to it, under the effect of force, in such a way that the slide (6) can be displaced beyond the position defined by the engagement stop (17) when it engages the cam (9) towards the center of the profile bar (3), provided with insertion orifices (4), each slide (6) being provided on its underside with two guide webs (25, 26) which extend over approximately the entire length of the slide (6) and run at a distance from one another and which have projections on their undersides, these projections forming said plurality of stops (19*a*, 19*b*, 20) interacting with the cams (9) of the profile bar (3), said folder including essentially V-shaped profile bar margins and said profile bar having a cut edge (10) defined on its bottom section, said cut edge forming in the vicinity of the essentially V-shaped profile-bar margins, shoulders (15, 16) which slope down towards the bottom of the profile bar.

2. Folder for receiving documentary material, especially tabulating paper, with two covers, at least one of which is provided in the region of the folder spine with a profile bar which has a trough part with insertion orifices for thread-on wires serving to retain the documentary material and onto which slides for firmly clamping the thread-on wires can be clipped, these slides having front and rear ends and a guide partially surrounding the profile bar, each slide being made hook-like at one end, the profile bar being provided in its trough part at each bar end with at least one cam (9) which interacts with a plurality of stops (19*a*, 19*b*, 20) on each slide including at least a first stop (20) to counteract the pulling-off of the slides from the profile bar, and at least a second stop (19*a*, 19*b*) to determine the position of the slides in a hanging position in which their hook-like ends project beyond the ends of the profile bar, there being provided on the slide at least one further stop which is an engagement stop (17) extending from the rear end of the slide for engaging the cam (9) for defining the position of the slide in a filing position in which the rear end of the slide pushed from the bar end onto the particular thread-on tongue terminates essentially flush with the end of the profile bar, said engagement stop (17) of each slide (6) being designed to fit into the trough part (12) and to be moved by the user of the folder over the cam (9) assigned to it, under the effect of force, in such a way that the slide (6) can be displaced beyond the position defined by the engagement stop (17) when it engages the cam (9) towards the center of the profile bar (3), provided with insertion orifices (4), each slide (6) being provided on its underside with two guide webs (25, 26) which extend over approximately the entire length of the slide (6) and run at a distance from one another and which have projections on their undersides, these projections forming said plurality of stops (19*a*, 19*b*, 20) interacting with the cams (9) of the profile bar (3), said guide webs (25, 26) being provided with notches (18*a*) towards the rear end of the slide (6), said notches being formed by projections of the guide webs (25, 26).

3. Folder according to claims 1 or 2, wherein each of the cam (9) assigned to an engagement stop (17) includes a profile-bar bottom section punched out of the profile bar (13) and extending obliquely upwards towards the end of the profile bar.

4. Folder according to claim 3, wherein each engagement stop (17) has a stop face (17*a*) which extends at an angle ($\alpha$) of at most 90° to the bottom of the slide (6).

5. Folder according to claim 3, wherein each engagement stop (17) has a projection (17*b*) catching under the profile bar bottom section.

6. Folder according to claim 1, wherein the cut edge (10) is bent in the region of the shoulders (15,16) towards the bottom of the profile bar.

7. Folder according to claim 1, wherein the additional stops (19*a*,19*b*,20) on the guide webs (25,26) are positioned on the shoulders (15,16).

8. Folder according to claim 7, in which two of the stops (19*a*,19*b*,20) are arranged in a pair of stops (19*a*,*b*) which, in a hanging position of the folder provided with slides (6) having hook-like ends, form engagement notches for the shoulders (15,16).

9. Folder according to claim 1 or 2, including means for elastically deforming the rear end of the slide (6) about a transverse axis extending perpendicularly to its longitudinal axis.

10. Folder according to claim 1 or 2, wherein the engagement stop (17) of each slide (6) is formed by a part of a cross-web (27) which connects to one another two guide webs (25,26) extending over approximately the entire length of the slide (6) and running on its underside at a distance from one another.

11. Folder according to claim 10, wherein the distance between the guide webs (25,26) is at least equal to double the thickness of the thread-on wires (5).

12. Folder according to claim 1 or 2, wherein force introduction ramps (23,24) are provided in the region of the ends of each slide (6) on its upper side, and each slide (6) is equipped between the force introduction ramps (23,24) with laterial finger-grip depressions (21,22) located opposite one another.

13. Folder according to claim 12, wherein the finger-grip depressions (21,22) extend obliquely downwards from the upper side of the slide.

14. Folder according to claim 12, wherein the force introduction ramps (23,24) and the finger-grip depressions (21,22) are provided with knurling.

15. Folder according to claim 1 or 2, wherein each slide (6) is provided at its rear end with a sloping face (18) which makes it easier to raise the rear end of the slide.

16. Folder according to claim 15, wherein the sloping face (18) is formed by an outer face of the engagement stop (17).

* * * * *